US006773190B2

(12) United States Patent
Matsumoto et al.

(10) Patent No.: US 6,773,190 B2
(45) Date of Patent: Aug. 10, 2004

(54) IMPLEMENT FOR DISPENSING PREPARATION

(75) Inventors: Miho Matsumoto, Osaka (JP); Ryo Miyagawa, Osaka (JP)

(73) Assignee: Rohto Pharmaceutical Co., Ltd., Osaka (JP)

( * ) Notice: Subject to any disclaimer, the term of this patent is extended or adjusted under 35 U.S.C. 154(b) by 0 days.

(21) Appl. No.: 10/107,350

(22) Filed: Mar. 28, 2002

(65) Prior Publication Data

US 2003/0185618 A1 Oct. 2, 2003

(51) Int. Cl.[7] ..... B43K 5/12
(52) U.S. Cl. ..... 401/194; 401/68; 401/75
(58) Field of Search ..... 401/194, 192, 401/68, 70, 75, 79, 86

(56) References Cited

U.S. PATENT DOCUMENTS

| | | | | |
|---|---|---|---|---|
| 1,783,754 A | * | 12/1930 | Stepelton | 401/175 |
| 2,815,123 A | * | 12/1957 | Safianoff | 401/87 |
| 5,437,513 A | * | 8/1995 | Favre | 401/68 |
| 5,842,802 A | | 12/1998 | Lang et al. | |
| 6,039,483 A | * | 3/2000 | Szekely | 401/50 |
| 6,340,258 B2 | * | 1/2002 | Gueret | 401/87 |
| 6,592,278 B1 | * | 7/2003 | Holthaus | 401/66 |

FOREIGN PATENT DOCUMENTS

| | | |
|---|---|---|
| JP | 48-37074 U | 5/1973 |
| JP | 57-181203 | 11/1982 |
| JP | 60-73417 U | 5/1985 |
| JP | 62-204514 U | 12/1987 |
| JP | 63-3311 U | 1/1988 |
| JP | 64-55814 U | 4/1989 |
| JP | 3-76511 | 7/1991 |

* cited by examiner

*Primary Examiner*—Gregory L. Huson
*Assistant Examiner*—Huyen Le
(74) *Attorney, Agent, or Firm*—Smith Patent Office

(57) ABSTRACT

An implement for dispensing a preparation is provided with a cylinder member having a cylindrical wall extending along an axis of the cylinder member, a preparation moving mechanism for moving a preparation along the axis of the cylinder member, the preparation moving mechanism including a movable member having a surface extending in parallel with the cylindrical wall of the cylinder member, and a space former for defining a space between the cylinder member and the movable member. A representation member is provided on one and/or both of the opposite surfaces of the cylinder member and the operative member.

18 Claims, 11 Drawing Sheets

IMPLEMENT FOR DISPENSING PREPARATION

BACKGROUND OF THE INVENTION

1. Field of the Invention

This invention relates to an implement for dispensing a stick-shaped or bar-shaped preparation such as lipstick for cosmetic use, lip moisturizer for medical use, and paste.

2. Discussion of the Related Art

U.S. Pat. No. 5,842,802 discloses such an implement. The construction of this implement is shown in FIGS. 10 and 11. An implement 1 has a double tubular casing structure including an elongated outer cylinder member 10, and an inner cylindrical operative member 12 mounted inside the cylinder member 10 to substantially accommodate a preparation C therein. The cylinder member 10 and the operative member 12 each have a closed end at a bottom portion thereof.

A screw shaft 14 extending in an axial direction of the cylinder member 10 is fixedly supported on the bottom portion of the cylinder member 10. The screw shaft 14 passes through the bottom portion of the operative member 12 and protrudes the interior of the operative member 12. The bottom portion of the operative member 12 and the screw shaft 14 are engaged along the axial direction of the casing by a hook portion 14*a* formed at a base end of the screw shaft 14. With this arrangement, the operative member 12 is rotatable relative to the cylinder member 10 and is held inside the cylinder member 10 with its detachment from the cylinder member 10 disabled.

A tubular support member 16 for retractably extruding the preparation C while holding the preparation C is mounted inside the operative member 12. Although not illustrated, the support member 16 is spline-coupled to the operative member 12 in such a manner that the support member 16 is slidable along the axial direction of the casing 12 relative thereto with its rotation relative to the operative member 12 disabled. The support member 16 is engageably mounted on the screw shaft 14.

A lead end portion or upper part of the operative member 12 protrudes out of the cylinder member 10. A knob 12*a* is formed along an outer cylindrical surface on the protruded part of the operative member 12. A cap 18 is detachably mounted on a lead end of the operative member 12.

When a user dispenses the preparation C with use of the implement 1, the user detaches the cap 18 and turns the operative member 12 relative to the cylinder member 10 by holding the cylinder member 10 and the knob 12*a*. Turning the operative member 12 relative to the cylinder member 10 rotates the support member 16 relative to the screw shaft 14. Then, as shown in FIG. 11 (see the right half portion in FIG. 11), the support member 16 is advanced toward the lead end portion of the operative member 12 along the axial direction of the operative member 12. As a result, the preparation C is extruded or dispensed out of the lead end portion or inlet/outlet portion of the operative member 12. On the other hand, when the user rotates the operative member 12 relative to the cylinder member 10 in the direction opposite to the direction of withdrawing the preparation C, the support member 16 is moved in the direction opposite to the direction of extruding the preparation C, and, as a result, the preparation C is retracted in the operative member 12.

In the aforementioned implement 1, since the knob 12*a* is provided in the vicinity of the inlet/outlet portion, the user can extrude or withdraw the preparation C by turning the knob 12*a* of the operative member 12 with his or her thumb and index finger while holding the cylinder member 10.

However, the aforementioned implement has the following drawbacks.

1) A variety of representations such as pictures and patterns, information such as ingredients of the preparation, and trademark are provided on an outside surface of the implement. Generally, such representation is directly applied on the outer surface of the implement by printing, adhesion of seal member, covering member or the like, which are likely to be deteriorated by scuffing or adhesion of foreign matters. Such deteriorated representation will cause the user to feel annoyed when using the preparation accommodated in the implement itself despite the fact that the representation merely constitutes an external appearance of the implement. Particularly, in the case where the preparation is a stick-shaped or bar-shaped lipstick for cosmetic use or a moisturizer for medical use, a user will dislike the poor appearance of the representation in the aspect of hygiene, which may be one of the causes to dispose the preparation in incomplete use. In particular, the implement 1 which realizes one-hand manipulation is constructed in such a manner that the representation is provided on the outer surface of the cylinder member 10 serving as a gripping portion. Accordingly, it is highly likely that the representation wears out or seal is peeled off due to repeated frictional contacts with a user's hand, which may expedite deterioration of the representation. Therefore, there is the demand for an implement free from provoking a user hesitant feeling in use in view of hygiene owing to the external appearance of the implement by effectively suppressing deterioration of representation.

2) The implement 1 is operated in such a manner as to rotate the operative member 12 fitted in the cylinder member 10 by way of the knob 12*a* to move the preparation C in and out of the implement 1. If an excessive gap exists between the operative member 12 and the cylinder member 10, the space between the inner surface of the operative member 12 and the outside surface of the screw shaft 14 varies, thereby deterring a smooth sliding of the support member 16 or causing the screw shaft 14 to intrude into the preparation C. As a result, the proper extrusion and retraction movement of the preparation C are obstructed. In view of this, generally, the operative member 12 and the cylinder member 10 are so formed as to render the outer cylindrical surface of the operative member 12 into close contact with the inner surface of the cylinder member 10 substantially without a clearance.

Such a close contact of the outer cylindrical surface of the operative member 12 and the inner surface of the cylinder member 10, however, is liable to obstruct a smooth rotation of the operative member 12 due to a frictional resistance of the operative member 12 against the cylinder member 10, which may obstruct one hand manipulation of the implement 1.

There has been demand for an implement having an improved operability of one hand and smooth extrusion and retraction movement of the preparation C to need a less external force.

3) Generally, a preparation C for medical care of lips has been formulated to attain a melting point from 40 to 50? in view of the fact that the preparation C is so designed as to soften by a temperature of lips for the purpose of attaining desirable lubrication. Accordingly, long time gripping of the cylinder member 10 in an attempt to dispense the preparation C raises the temperature of the preparation C owing to the body temperature or temperature of a hand of a user, which may adversely affect the chemical property of the preparation or cause a phenomenon such as so-called "bucket bending" or "bucket falling" in which support of the preparation C on the support member 16 is loosened due to softening of the preparation C, thereby hindering smooth extrusion and retraction movement of the preparation C. Accordingly, there has been the necessity of suppressing deterioration and softening of the preparation C due to the influence of body temperature to effectively prevent occurrence of such "bucket bending" or "bucket falling" phenomenon. Further, there has been the necessity of preventing deterioration of effective ingredients which are included in the preparation and are liable to be deteriorated by ultraviolet rays or other external causes.

SUMMARY OF THE INVENTION

It is an object of the present invention to provide an implement for dispensing a preparation which is free from the aforementioned drawbacks residing in the prior art.

According to an aspect of the invention, an implement for dispensing a preparation, comprises a cylinder member having a cylindrical wall extending along an axis of the cylinder member, a preparation moving mechanism for moving a preparation along the axis of the cylinder member, the preparation moving mechanism including a movable member having a surface opposite to the cylindrical wall of the cylinder member, and a space former for defining a space between the cylinder member and the movable member.

These and other objects, features and advantages of the present invention will become more apparent upon a reading of the following detailed description and accompanying drawing.

DETAILED DESCRIPTION OF THE PREFERRED EMBODIMENTS OF THE INVENTION

Figure 1:
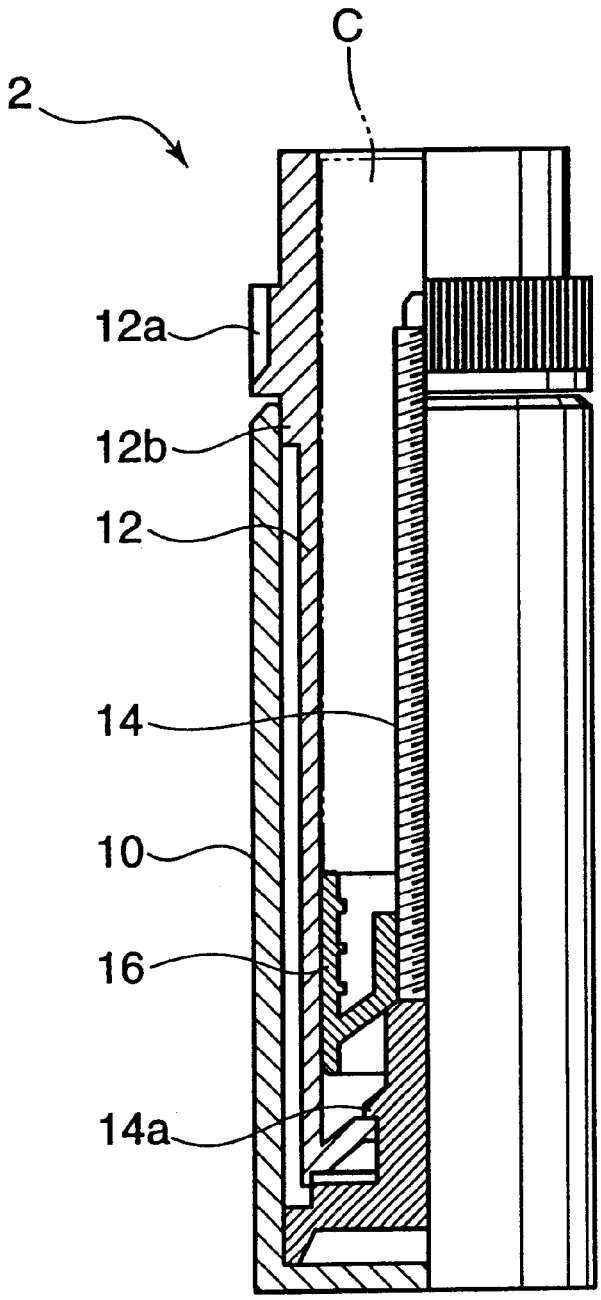
FIG. 1 is a half sectional view showing an implement in accordance with an embodiment of the invention.
Figure 2:
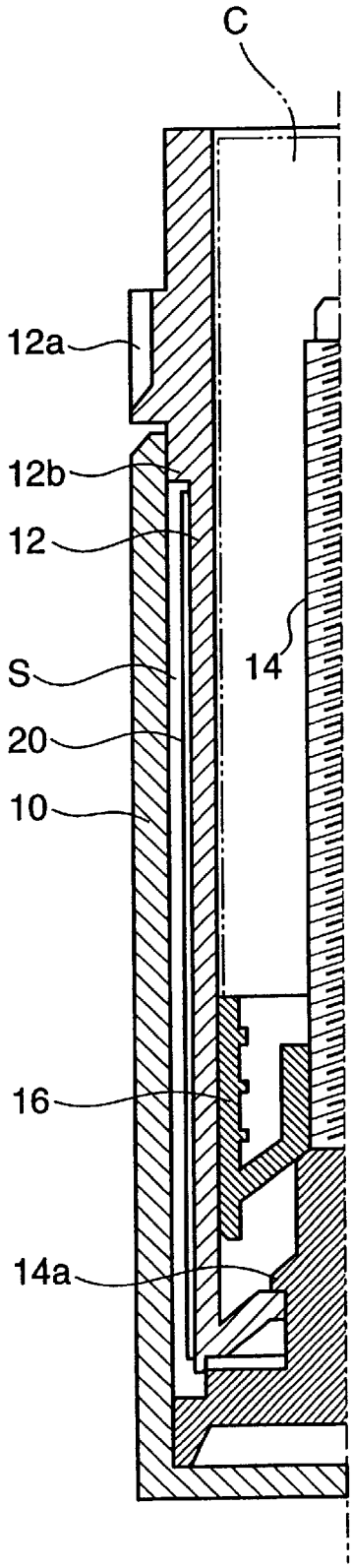
FIG. 2 is an enlarged view of the implement shown in FIG. 1, specifically showing a left half part of the implement.

Referring to FIGS. 1 and 2 showing an implement adapted to house a preparation in accordance with an embodiment of the invention, an implement 2 includes an outer cylinder member 10, and a preparation moving mechanism including an operative member 12 housed in the cylinder member 10, a movable support member 16, and a screw shaft 14. The operative member 12 has a cylindrical outside surface extending in parallel with the cylinder member 10.

A screw shaft 14 extends in an axial direction of the cylinder member 10. The screw shaft 14 is fixedly supported on the bottom portion of the cylinder member 10. The screw shaft 14 if passes through the bottom portion of the operative member 12 and protrudes the interior of the operative member 12. The bottom portion of the operative member 12 and the screw shaft 14 are engaged along the axial direction of the casing by a hook portion 14*a* formed at a base end of the screw shaft 14.

The support member 16 for retractably extruding a preparation C while holding the preparation C is mounted inside the operative member 12. The support member 16 is movable or slidable along an axis of the cylinder member 10 relative thereto because its rotation relative to the operative member 12 is disabled. The support member 16 is engageably mounted on the screw shaft 14.

A manipulator knob is formed on an outside surface of an upper portion of the operative member 12. A cap is detachably mounted on a lead end of the operating casing 12.

Rotating the operative member 12 relative to the cylinder member 10 by turning the knob 12*a* while holding the cylinder member 10 extrudes or retracts a stick-shaped or bar-shaped preparation C out of and into the operative member 12 as the support member 16 is moved forward.

The operative member 12 has an outer diameter sufficiently smaller than an inner diameter of the cylinder member 10 to define, as shown in FIG. 2, a space S between the cylinder member 10 and the operative member 12.

As shown in FIGS. 1 and 2, a projection band or space former 12*b* is formed right below the knob 12*a* of the operative member 12. Rendering the projection band 12*b* in contact with the inner surface of the cylinder member 10 holds the operative member 12 inside the cylinder member 10 while securing the space S in a certain range. The projection band 12*b* is endlessly formed along the entire circumference of the operative member 12. As a result, the space S is kept in a substantially closed state by suppressing external air from flowing into the space S.

A representation member is constructed by a film member 20 adhered on the outer cylindrical surface of the operative member 12 inside the cylinder member 10. The film member 20 is printed with such representation as figure, trademark, manufacture name, and indication of ingredients included in the preparation C. The film member 20 is made of a light blocking material. The cylinder member 10 is entirely made of a transparent or semitransparent material. Thereby, a user can recognize the representation of the film member 20 through the cylinder member 10 from outside.

Figure 10:
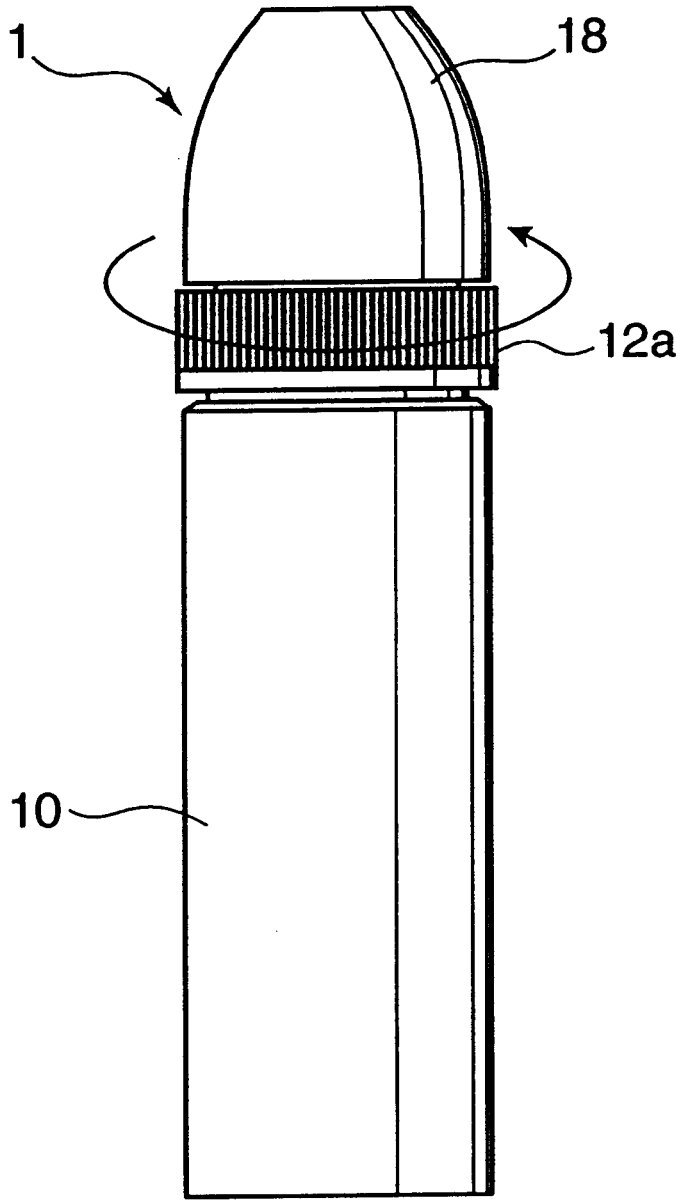
PRIOR ART FIG. 10
FIG. 10 is a diagram showing an external appearance of a conventional implement.
Figure 11:
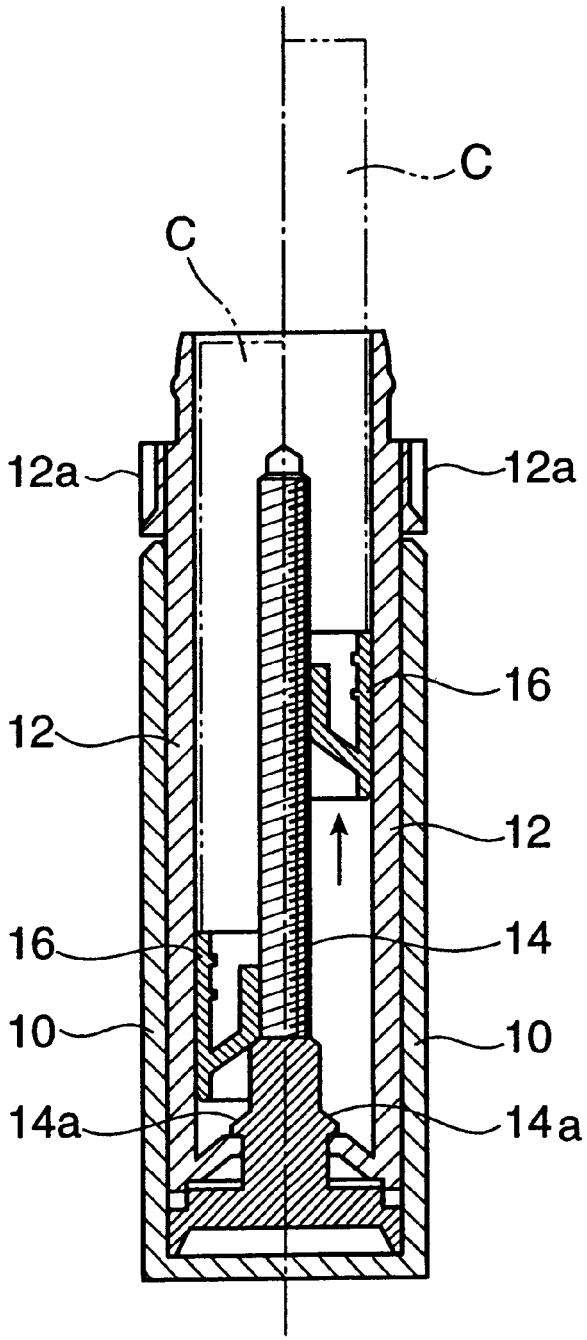
PRIOR ART FIG. 11
FIG. 11 is a cross sectional view showing the conventional implement.

This implement 2 which has the above-described construction provides the following advantageous effects. The implement 2 is constructed in such a manner that the inner surface of the cylinder member 10 and the operative member 12 are rendered in contact merely by way of the projection band 12*b*, which remarkably reduces the contact surface area of the operative member 12 with the cylinder member 10. Thereby, a frictional resistance exerted in relative rotation of the operative member 12 to the cylinder member 10 is lessened. As a result, compared to the conventional implement 1 shown in FIGS. 10 and 11, a user can turn the operative member 12 with a smaller external force. Thus, one hand manipulation of the implement 2 to extrude or retract the preparation C through the implement 2 can be facilitated, thus improving the operability of the implement 2.

Further, the operative member 12 is held in the cylinder member 10 while keeping the space S in a certain range by the projection band 12*b*. Accordingly, there is no likelihood that the operative member 12 may radially displace relative to the cylinder member 10 during the extrusion and retraction movement of the preparation C. This arrangement effectively eliminates the drawback due to displacement of the operative member 12 to the cylinder member 10 such as obstruction of smooth sliding of the support member 16 due to variation in the distance between the inner cylindrical surface of the operative member 12 and the screw shaft 14, and intrusion of the screw shaft 14 into the preparation C.

In this embodiment, an air layer is formed in the space S defined by the cylinder member 10 and the operative member 12. The air layer provides a heat insulating effect. Furthermore, the operative member 12 housed with the preparation C is covered by the film member 20. As a result, the chemical property of the preparation C is much more stabilized from the influence of the external environment, for example, atmospheric temperature outside the implement 2, ultraviolet rays and other light rays. This arrangement effectively suppresses the deterioration of the preparation C owing to the body temperature even in the case that the preparation C is repeatedly extruded and retracted out of and into the implement 2 in the state that the cylinder member 10 is kept on manually being held. This arrangement is also advantageous in preventing the occurrence of a so-called "bucket bending" or "bucket falling" phenomenon due to softening of the preparation C in advance. Also, this arrangement is advantageous in protecting the preparation C from the influence of the external environment even if the implement 2 housed with the preparation C has been inadvertently left under the direct sunlight.

The film member 20 applied with representation of figures or the like is attached to the operative member 12, and the implement 2 is constructed in such a manner that a user can recognize the representation through the cylinder member 10 from outside. This arrangement keeps the film member 20 from being smeared or scuffed. Thus, this arrangement is advantageous in effectively preventing a user from provoking hesitant feeling in use of the preparation in the aspect of hygiene due to deteriorated state of the film member 20. Particularly, in the implement 2 in which the extrusion and retraction is performed with one hand manipulation by holding the cylinder member 10, it is highly likely that the film member 20 may be smeared in a short period if the film member 20 is attached on the outer surface of the cylinder member 10. However, since the film member 20 is provided between the cylinder member 10 and the operative member 12 in this embodiment, the arrangement of this embodiment effectively prevents the film member 20 from being smeared or scuffed. Thereby, the film member 20 can be kept in a desirably clean state as in an initial stage of use for an extended period.

In the case where the film member 20 is provided between the cylinder member 10 and the operative member 12, there is a possibility that a frictional contact of the film member 20 against the cylinder member 10 may damage the film member 20. However, as mentioned above, the operative member 12 is securely held in the cylinder member 10 while keeping the space S within a desirable range by the projection band 12*b*. Accordingly, this arrangement is free from a frictional contact of the film member 20 against the cylinder member 10, which is resultantly free from damage of the film member 20 due to such a frictional contact.

The following modifications and alterations can be applied with respect to the implement 2.

1) It may be preferable to form a cross section of the projection band 12*b* into a tapered shape directing from a base end thereof toward a distal end thereof in such a manner that the projection band 12*b* comes into linear contact with the inner surface of the cylinder member 10. This altered arrangement enables to minimize the contact surface area of the projection band 12*b* with the inner surface of the cylinder member 10. Thereby, a frictional resistance of the cylinder member 10 against the operative member 12 caused by the extrusion and retraction movement of the preparation C can be minimized despite the fact that the projection band 12*b* is endlessly formed along the circumference of the operative member 12.

2) The projection band 12*b* may be formed on an inner surface of the cylinder member 10. Alternatively, the projection band 12*b* may be formed at the bottom portion of the cylinder member 10. As a further altered arrangement, the projection band 12*b* may be formed intermittently in place of the endless formation along the entire circumference of the operative member 12. In other words, as far as the space S can be kept in a desirable range, any projection band 12*b* is formable with respect to the arrangement, the number, the alignment, the site, the configuration, etc. Preferably, however, providing the projection band 12*b* on the operative member 12 quite closely to the upper opening of the cylinder member 10, as in the first embodiment, enables to support the operative member 12 by the projection band 12*b* at a location close to the knob 12*a* to which most of an external force is exerted in the extrusion and retraction movement. This arrangement is advantageous in effectively preventing radial displacement of the operative member 12 relative to the cylinder member 10. Further, this arrangement secures a large space for attaching the film member 20 on the operative member 12. Further, forming the projection band 12*b* endlessly along the entire circumference of the operative member 12, as in the first embodiment, enables to keep the space S from varying beyond the certain range and enhance heat insulation effect while efficiently blocking airflow into the space S. Furthermore, providing the projection band 12*b* at the bottom portion of the cylinder member 10 enables to improve the operability of the implement 2.

3) In addition to the arrangement in which a seal printed with a picture and/or a pattern (hereinafter, simply referred to as "image") is attached to the operative member 12 as a representation member, it may be preferable to attach a seal printed with an image in association with the image on the seal attached to the operative member 12 to the cylinder member 10. In this altered arrangement, as the preparation C is being withdrawn, the image on the cylinder member 10 and the image on the operative member 12 are superimposingly displayed in relative rotation of the operative member 12 to the cylinder member 10, whereby a user can see a composite image of these images through the cylinder member 10. This configuration provides the implement with sophisticated appearance. In this case, it is preferable to attach the seal on the inner surface of the cylinder member 10 in such a manner that a user can see the image of the seal through the cylinder member 10 from outside in view of countermeasures against smear and damage of the seal.

Figure 3:
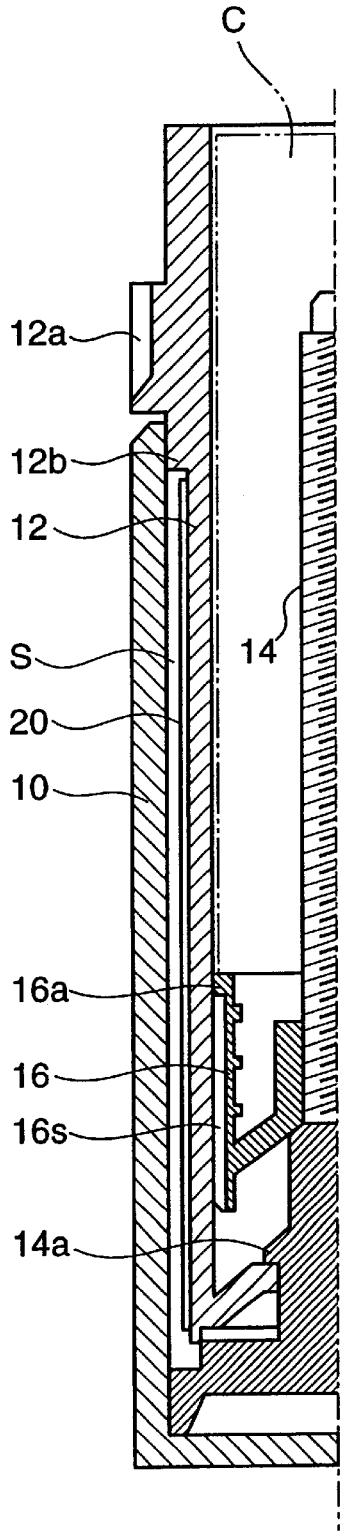
FIG. 3 is an enlarged view of a modification of the implement shown in FIG. 1.

4) It may be preferable to define a clearance 16*s* between the operative member 12 and the support member 16 in a certain range, to make the operative member 12 of a transparent or a semitransparent material, and to attach a seal printed with an image on the outer cylindrical surface of the support member 16, as shown in FIG. 3. This altered arrangement enables to display the image of the seal on the support member 16 in a superimposing manner in relative rotation of the operative member 12 to the support member 16 when a user extrudes and retracts the preparation C out of and into the operative member 12. This configuration also provides the implement with sophisticated appearance. In this case, it is preferable to provide a projection 16*a* on the operative member 12 or on the support member 16 to keep the clearance 16*s* between the operative member 12 and the support member 16 in a certain range.

5) Attaching the film member 20 on the cylinder member 10, the operative member 12, and/or the support member 16 enables to effectively prevent occurrence of a so-called "bucket bending" or "bucket falling" phenomenon due to deterioration and softening of the preparation C resulting from the influence of the external environment such as light, temperature, etc. The film member 20 serves as a cover. As a covering representation member, there may be a plastic film sheet made of polypropylene, polyethylene, polyethylene terephthalate, etc., an aluminum sheet, a foam plastic film and the like. Further, it may be appreciated to form a print layer by applying printing directly onto an inner surface of the cylinder member 10 or an outer surface of the operative member 12, or the opposite surfaces of the cylinder member 10 and the operative member 12 as a covering representation member. A print layer is formed by known printing technique such as silkscreen printing, photogravure printing, flexographic printing, dry offset printing, insert mold printing, decalcomania printing or the like. In this embodiment, since the covering representation member is protected from the influence of the external environment by the cylinder member 10, a fragile material such as paper may be usable as a material for the covering representation member in this embodiment.

To assuredly keep light from coming onto the preparation, alternatively, a covering representation member may be added with a material that absorbs ultraviolet light and/or a material that blocks ultraviolet light. Materials capable of blocking ultraviolet light include, for example, titanium dioxide, iron oxide or the like. In particular, it may be preferable to use fine particles of titanium dioxide having 30 $\mu$m or smaller or fine particles of iron dioxide having 30 $\mu$m or smaller. Materials capable absorbing ultraviolet light include, for example, benzotriazole, cyanoacrylate, salicylate, benzophenone or the like.

6) In the embodiment, the knob 12*a* is formed at the upper portion of the operative member 12. Alternatively, it may be preferable to form an opening in the bottom portion of the cylinder member 10 so as to expose part of the operative member 12 outside through the opening and to function the exposed part as a knob (manipulator) for rotating the operative member 12.

The manipulator for slidingly moving the support member 16 may be provided at a position other than the operative member 12. For instance, it may be possible to fabricate the cylinder member 10 and the operative member 12 as a one-piece unit (namely, multi-tubular casing structure) in such a manner that relative rotation of the operative member 12 to the cylinder member 10 is disabled. Exposing part of the screw shaft 14 through the bottom portion of the tubular structure and manipulating the exposed part of the screw shaft 14 as a manipulator enables to directly rotate the screw shaft 14.

Next, another embodiments of the invention are described. It should be appreciated that the following embodiments of the invention are different from the first embodiment in that an implement in accordance with the following embodiments is not of a one-hand-operable type as disclosed in the first embodiment. Primary objects for designing the implement in accordance with the following embodiments are prevention of smear and scuffing of a film member applied with representation, and prevention of deterioration and softening of a preparation C housed in the implement.

Figure 4:
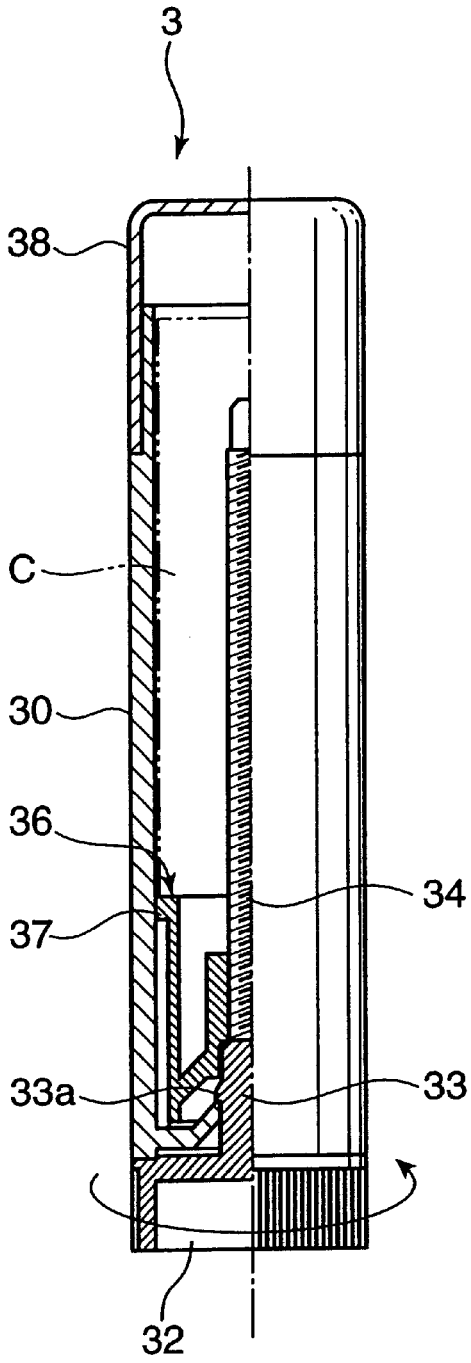
FIG. 4 is a half sectional view showing an implement in accordance with another embodiment of the invention.
Figure 5:
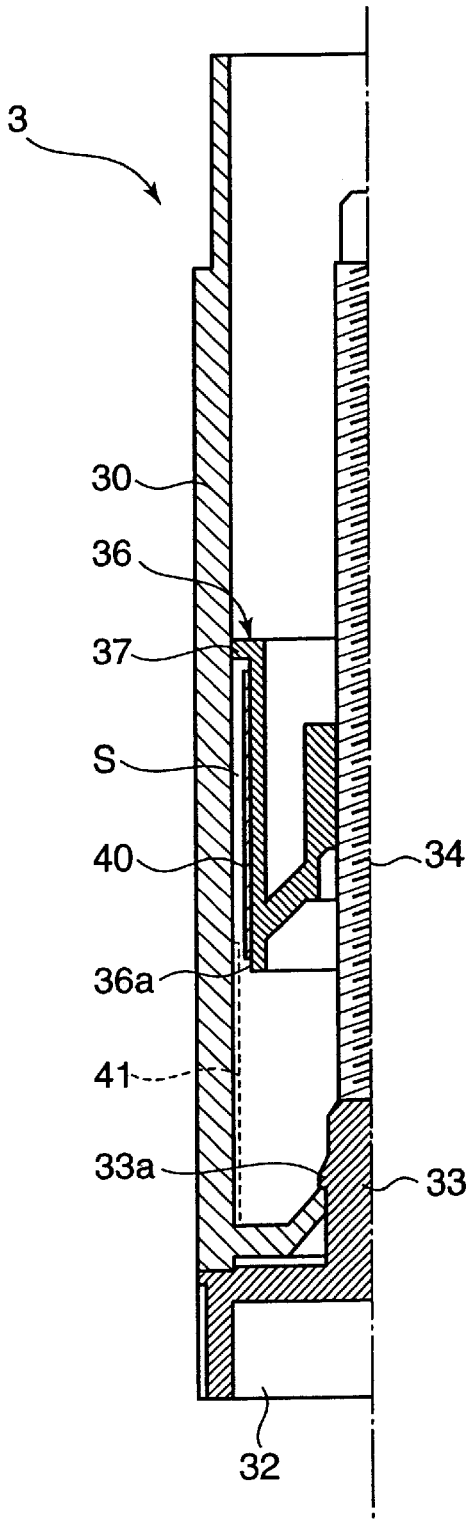
FIG. 5 is an enlarged view of the implement shown in FIG. 4, specifically showing a left half part of the implement.

FIGS. 4 and 5 are diagrams showing an implement in accordance with a second embodiment. As shown in FIGS. 4 and 5, an implement 3 adapted for housing a preparation includes an elongated transparent cylinder member 30 having a closed end at a bottom portion thereof to house a preparation C, a cap 38 detachably mounted on a lead end of the cylinder member 30, and a disc-like operative knob 32 (manipulator) assembled to the bottom portion of the cylinder member 30.

A centrally formed stem portion 33 of the knob 32 passes through a hole in the bottom portion of the cylinder member 30 and a hook portion 33*a* formed on the stem portion 33 is abutted against the bottom portion of the cylinder member 30. With this arrangement, the knob 32 is assembled to the cylinder member 30 to be rotatable relative to the cylinder member 30 with its detachment from the cylinder member 30 disabled.

A screw shaft 34 extends along the axial direction in the middle of the interior of the cylinder member 30. The screw shaft 34 is integrally connected to the stem portion 33 of the knob 32.

A cylindrical support member or movable member 36 for supporting a preparation C is provided inside the cylinder member 30. Although its illustration is omitted herein, the support member 36 is spline-coupled to the cylinder member 30 in such a manner that the support member 36 is movable in the axial direction of the cylinder member 30 relative thereto with its relative rotation prohibited thereto. The support member 36 is engageably mounted on the screw shaft 34. Namely, turning the screw shaft 34 by way of the knob 32 enables to slidingly move the support member 36 along the axial direction of the cylinder member 30. In this embodiment, the movable support member 36, the screw shaft 34, and the operative knob 32 combinedly constitute a preparation moving mechanism.

The support member 36 has a cylindrical outer surface whose diameter is smaller than an inner diameter of the cylinder member 30. Thereby, a space S is defined between the cylinder member 30 and the support member 36, as shown in FIG. 5. A flange portion or projection 37 rendered in sliding contact with the inner surface of the cylinder member 30 along its entire circumference is formed on the upper circumferential end portion of the support member 36. With this arrangement, the support member 36 is held in the cylinder member 30 while securing the space S in a certain range. The cylinder member 30 and the support member 36 are spline-coupled by the flange portion 37.

As shown in FIG. 5, a film member 40 printed with design representation is attached to the outer cylindrical surface of the support member 36 in such a manner that a user can recognize the design representation through the cylinder member 30 from outside. In this embodiment, the film member 40 printed with design representation is attached to the support member 36. Alternatively, the representation member may be constructed by a printed layer directly formed on the support member 36 by silkscreen printing.

In the case where the preparation C is dispensed from the implement 3, a user detaches the cap 38 and turns the knob 32 relative to the cylinder member 30 while holding the knob 32 and the cylinder member 30 with his or her hand. Then, the support member 36 is moved forward along the axial direction of the cylinder member 30 with the result that the preparation C is dispensable out of the lead end of the cylinder member 30. Turning the knob 32 relative to the cylinder member 30 in the direction opposite to the dispensing direction enables to retract the preparation C in the cylinder member 30.

In the implement 3 in accordance with the second embodiment, as mentioned above, an air layer is formed in the space S between the support member 36 and the cylinder member 30, and the film member 40 as a covering member is attached to the support member 36. With this arrangement, the preparation C (particularly, a base end or a lower end of the preparation C) is protected from the influence of the external environment. Thereby, this arrangement is advantageous in preventing a so-called "bucket bending" or "bucket falling" phenomenon resulting from deterioration and softening of the preparation C in advance.

Further, since the film member 40 provided with design representation or its equivalent is provided inside the transparent cylinder member 30, smear and scuffing of the film member 40 can be desirably prevented. Accordingly, similar to the arrangement of the implement 2 in accordance with the first embodiment, the implement 3 effectively keeps a user from provoking hesitant feeling in use in the aspect of hygiene due to deterioration of the film member 40. Further, the support member 36 is movable while securing the space S in a certain range by the projection band 12*b*. This arrangement provides a damage-free film member 40 resulting from a frictional contact of the film member 40 against the cylinder member 30.

Furthermore, in the implement 3, the representation such as the name of the article on the film member 40 is moved in the axial direction of the cylinder member 30 in association with the extrusion and retraction movement of the preparation C. This arrangement provides the implement with an interesting viewing.

In the implement 3, a seal printed with an image serving as the film member 40 is attached to the support member 36, and a seal printed with an image in association with the image on the seal attached to the support member 36 is attached to the cylinder member 30. With this arrangement, a user can see a composite image of the image on the cylinder member 30 and the image on the support member 36 in a superimposing manner during relative rotation of the support member 36 to the cylinder member 30 in the case where the use is about to withdraw the preparation C for dispensing the preparation C. Thereby, the implement 3 is provided with a more sophisticated appearance through the cylinder member 30, thus providing additional commercial value to the implement. In this case, it is preferable to attach the seal on the inner surface of the cylinder member 30 in such a manner that a user can see the image of the seal through the cylinder member 30 from outside in view of countermeasures against smear and damage of the seal.

In the second embodiment, the following modifications and alterations are applicable. The cylinder member 30 may be configured into a double-tubular structure comprised of an outer cylinder and an inner cylinder in such a manner that a clearance is defined between the inner cylinder and the outer cylinder. A projection may be formed on at least one of the outer surface of the inner cylinder and the inner surface of the outer cylinder to keep the space within a certain range. A film member provided with design representation may be provided in the space. In this altered arrangement, an air layer is formed in the space inside the cylinder member 30. Further, the film member blocks air from flowing into the preparation C. Thereby, the preparation C (particularly, a base end of the preparation C) is desirably protected from deterioration and softening due to the influence of the external environment.

Figure 6:
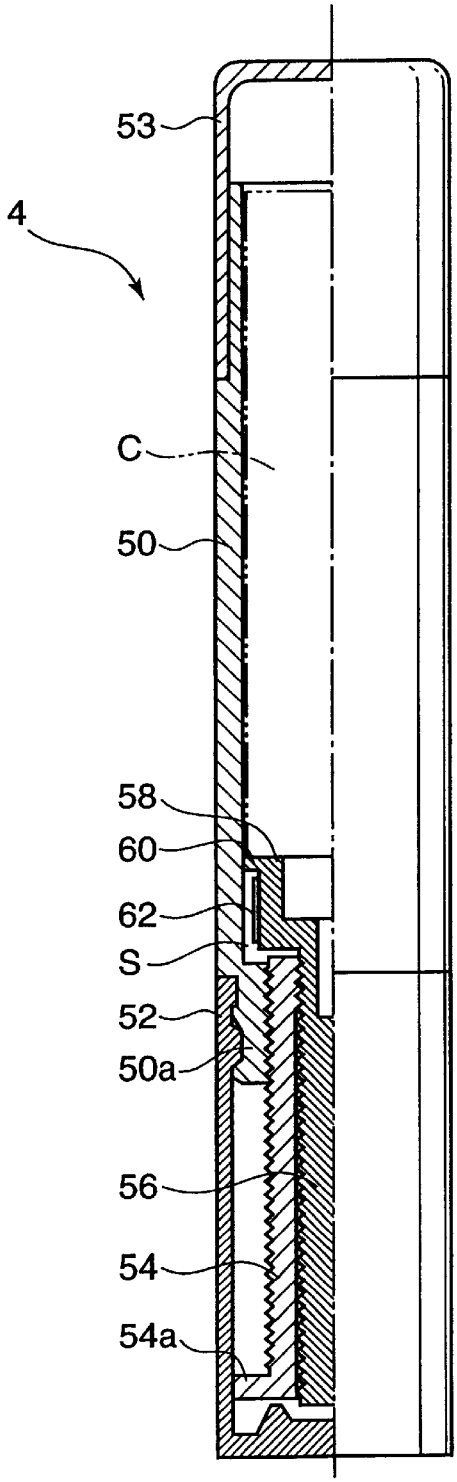
FIG. 6 is a half sectional view showing an implement in accordance with still another embodiment of the invention.
Figure 7:
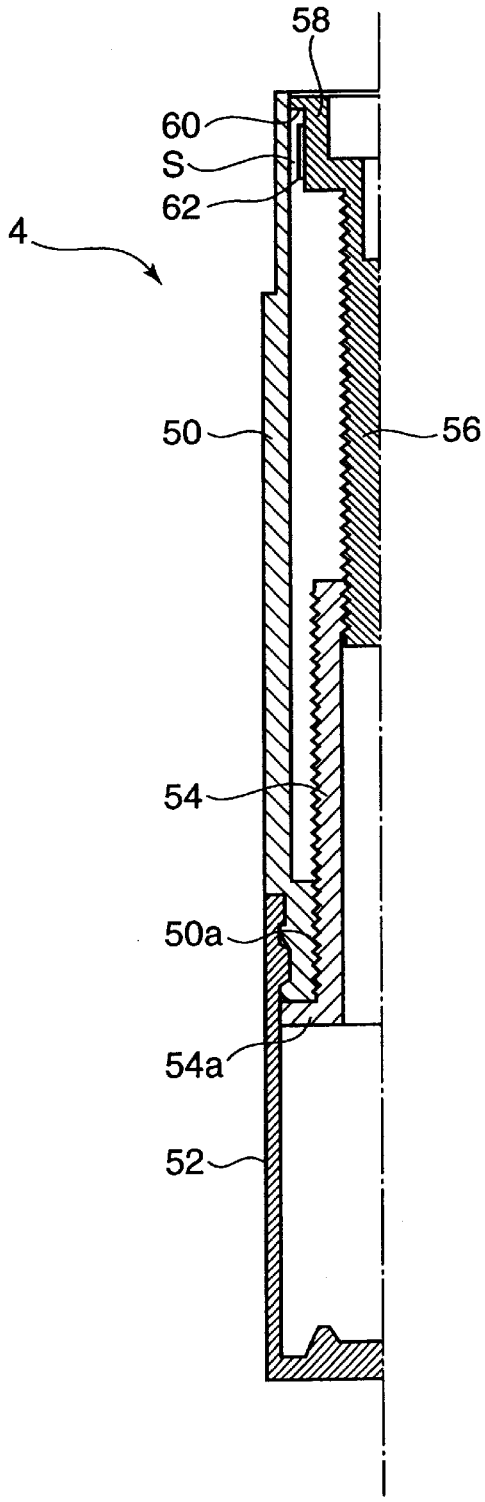
FIG. 7 is a sectional view of the implement shown in FIG. 6, specifically showing a state that a preparation housed in the implement is extruded.

Next, an implement in accordance with a third embodiment of the invention is described with reference to FIGS. 6 and 7. As shown in FIG. 6, an implement 4 includes an elongated transparent or semitransparent cylinder member 50 for accommodating a preparation C therein, a cap 53 which is detachably mounted on a lead end of the cylinder member 50, and a cylindrical operative member 52 (manipulator) which is rotatably connected to the bottom portion of the cylinder member 50.

In this embodiment, a cylindrical movable support member 58 for supporting the preparation C is integrally formed with a screw shaft 56 on a bottom thereof. The support member 58 has a cylindrical outer surface extending in parallel with the cylinder member 50. Although not illustrated, the support member 58 is spline-coupled to the cylinder member 50 in such a manner that the support member 58 is movable in the axial direction of the cylinder member 50 relative to the cylinder member 50 with its relative rotation disabled thereto.

The screw shaft 56 is operatively connected with the operative member 52 by a way of a screw cylinder 54. The screw cylinder 54 is formed with threads in both inner and outer surfaces thereof. The inner thread is engaged with a thread of the screw shaft 56 and the outer thread is engaged with a thread formed in a lower flange portion 50*a* of the cylinder member 50.

The screw cylinder 54 is formed with a flange portion 54*a* at a lower end portion thereof. Although not illustrated, the flange portion 54*a* is movable in the axial direction of the operative member 52 and is spline-coupled to the operative member 52 with its relative rotation disabled thereto.

Thereby, turning the operative member 52 relative to the cylinder member 50 enables to axially move the screw cylinder 54 and the screw shaft 56 relative to the operative member 52 in dual stepwise manner. In this way, the support member 58 is movable in dual stepwise manner along the axial direction of the cylinder member 50 in association with the dual-stage movement.

Similar to the second embodiment, a space S is defined between the support member 58 and the cylinder member 50. Rendering a flange portion or projection 60 formed on the upper circumferential end of the support member 58 in sliding contact with the inner surface of the cylinder member 50 enables to axially move the support member 58 relative to the cylinder member 50 while securing the space S in a certain range. The cylinder member 50 and the support member 58 are spline-coupled by way of the flange portion 60.

Further, a film member 62 printed with design representation is attached to the outer cylindrical surface of the support member 58 in such a manner that a user can recognize the name of the article and the like through the transparent cylinder member 50 from outside.

In dispensing the preparation C with use of the implement 4 having the above construction, a user detaches the cap 53 and turns the operative member 52 relative to the cylinder member 50. Then, the support member 58 is axially advanced in the cylinder member 50 with the result that the preparation C is dispensable from the lead end of the cylinder member 50.

In the implement 4 in accordance with the third embodiment, since the film member 62 printed with design representation and the like is provided inside the cylinder member 50, smear and damage of the film member 62 is desirably prevented. Further, the design representation on the film member 62 is moved in the longitudinal or axial direction of the cylinder member 50 in association with the extrusion and retraction movement of the preparation C. This arrangement provides the implement 4 with an interesting viewing.

An air layer is formed in the space S between the support member 58 and the cylinder member 50, and the film member 62 serving as a covering member is attached to the support member 58. This arrangement is advantageous in protecting the preparation C (particularly, a base end of the preparation C) from the influence of the external environment. This arrangement also prevents occurrence of a so-called "bucket bending" or "bucket falling" phenomenon due to deterioration and softening of the preparation C.

Next, an implement in accordance with a fourth embodiment of the invention is described with reference to FIGS. 8 and 9. A basic construction of an implement in accordance with the fourth embodiment is identical to that of the implement in accordance with the third embodiment. Accordingly, elements in the fourth embodiment that are identical to those in the third embodiment are denoted at the same reference numerals, and only the differences between the third embodiment and the fourth embodiment are described in detail in the following section.

Figure 8:
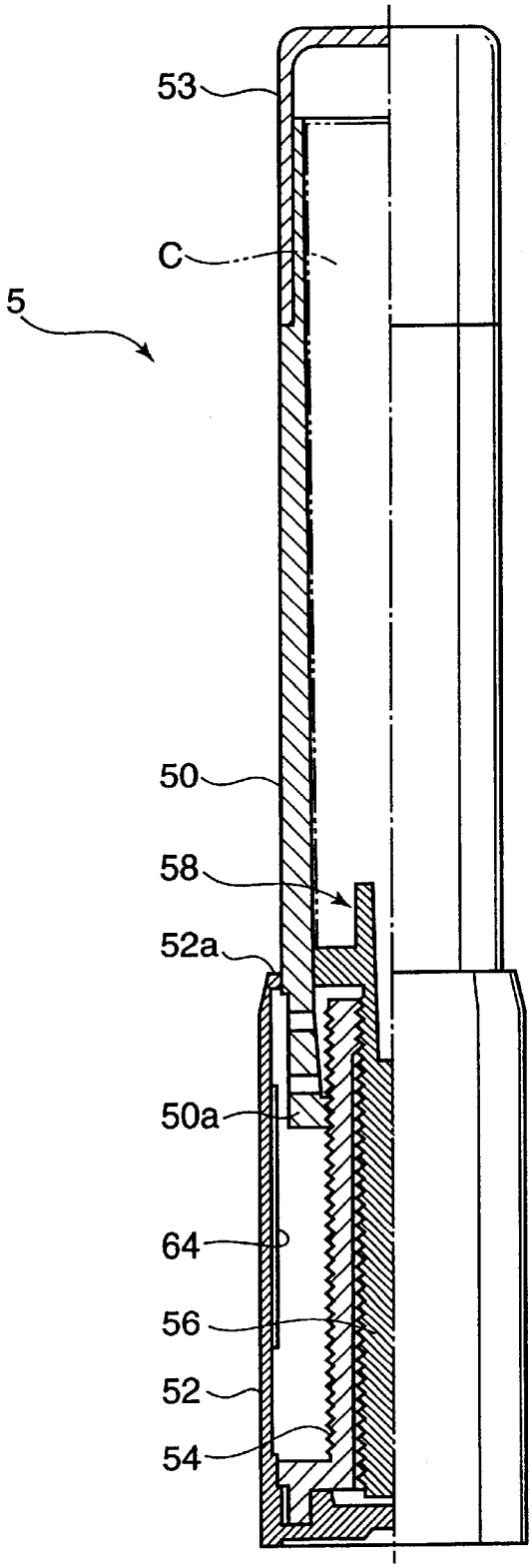
FIG. 8 is a half sectional view showing an implement in accordance with yet another embodiment of the invention.
Figure 9:
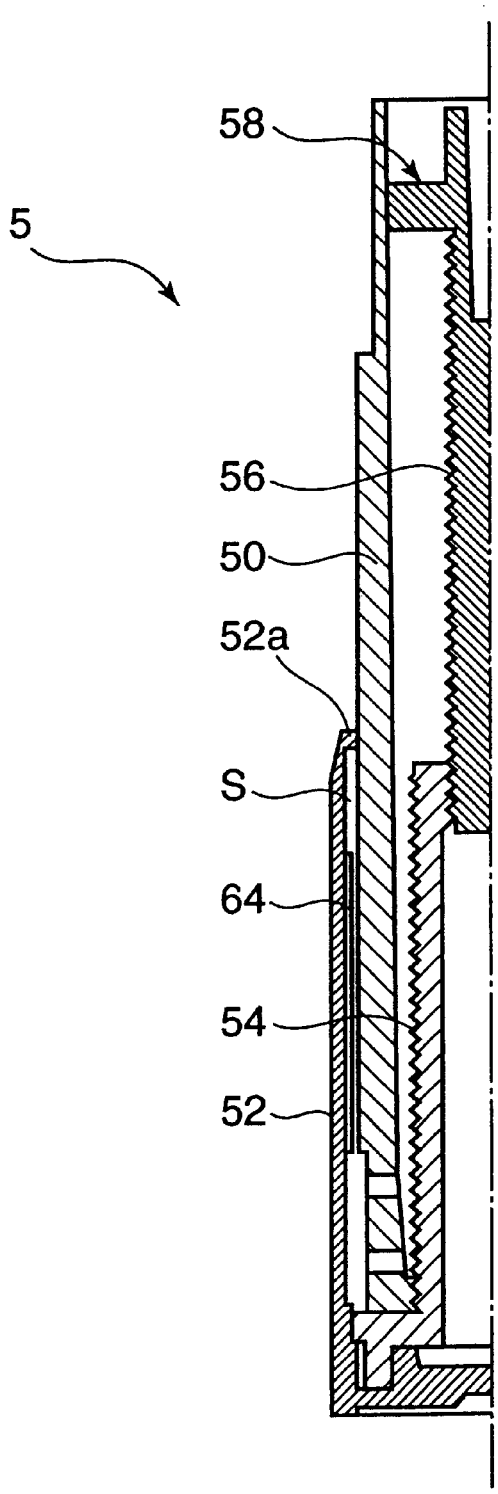
FIG. 9 is a sectional view of the implement shown in FIG. 8, specifically showing a state that a preparation housed in the implement is extruded.

An implement 5 in accordance with the fourth embodiment is constructed in such a manner that a screw cylinder 54 is fixedly supported on an operative member 52 and that the inner diameter of the operative member 52 is set sufficiently larger than the outer diameter of a cylinder member 50 in a state that the cylinder member 50 is fitted inside the operative member 52, as shown in FIG. 8. With this arrangement, turning the operative member 52 relative to the cylinder member 50 enables to rotate the operative member 52 together with the screw cylinder 54. As a result, as shown in FIG. 9, the lower end part of the cylinder member 50 is accommodated in the operative member 52. In other words, in the implement 5, the cylinder member 50 serves as a movable member, and the operative member 52 serves as a cylinder member and a manipulator.

The cylinder member 50 and the operative member 52 each have such a diameter that a space S is defined between the cylinder member 50 and the operative member 52 as shown in FIG. 5 when the lower end part of the cylinder member 50 is housed in the operative member 52. A rib 52*a* or projection is formed on the upper end of the operative member 52 along the entire inner circumference thereof in such a manner that the space S is kept in a certain range.

The operative member 52 is made of a transparent or semitransparent material. A film member 64 printed with design representation or the like is attached to the inner cylindrical surface of the operative member 52 in such a manner that the printed surface faces outside. With this arrangement, a user can recognize the design representation from outside through the operative member 52. In the implement 5, a film member is not attached to a support member 58 as in the fourth embodiment.

In dispensing the preparation C with use of the implement 5 having the above construction, a user detaches the cap 53 and turns the operative member 52 relative to the cylinder member 50 in a direction of extruding the preparation C housed in the implement 5. Then, the preparation C is dispensed out of the lead end of the cylinder member 50 in the similar manner as with the implement 4 in accordance with the third embodiment. In the implement 5, however, relative rotation of the operative member 52 to the cylinder member 50 in the direction of extruding the preparation C axially moves the operative member 52 relative to the cylinder member 50 in such a direction as to retract the lower end part of the cylinder member 50 in the operative member 52. Thereby, the lower end part of the cylinder member 50 is accommodated in the operative member 52.

In the implement 5 in accordance with the fourth embodiment, since the film member 64 printed with design representation or the like is attached to the inner surface of the operative member 52, the film member 64 is effectively protected from smear and damage. Further, the provision of the rib 52*a* securely keeps the space S in a certain range. With this arrangement, the preparation C is retractably extruded from the implement 5 without a likelihood that the operative member 52 may radially displace during the extrusion and retraction movement while effectively utilizing the space S defined between the cylinder member 50 and the operative member 52.

In the implement 5, the operative member 52 is axially moved relative to the cylinder member 50 in association with the extrusion and retraction movement of the preparation C. In this arrangement, it may be preferable to attach a seal printed with an image as the film member 64 to the operative member 52 and to print an image in association with the image on the seal on the operative member 52 on the outer surface of the cylinder member 50. Such an altered arrangement enables a user to see a composite image of the image on the operative member 52 and the printed image on the cylinder member 50 in a superimposing manner through the cylinder member 50 in association with relative rotation of the operative member 52 to the cylinder member 50 when the user extrudes the preparation C. This arrangement provides the implement 5 with an interesting viewing.

In the implement 5, it may be preferable to form the cylinder member 50 of a transparent material and to attach a film member printed with an image on a support member 58 in the same manner as with the implement 4 in accordance with the third embodiment. This altered arrangement provides the implement 5 with a further sophisticated appearance. In this case, in the same manner as with the implement 4 in accordance with the third embodiment, the support member 58 may be configured into a dish-like shape of a substantially U-shape in cross section in such a manner that a space is defined between the support member 58 and the cylinder member 50, and a film member may be attached to the circumference of the support member 58. With this altered arrangement, an air layer is formed in the space between the support member 58 and the cylinder member 50. Further, since the support member 58 is covered with the film member, the preparation C (particularly, a base end of the preparation C) is protected from the influence of the external environment. Thereby, occurrence of a so-called "bucket bending" or "bucket falling" phenomenon due to deterioration and softening of the preparation C can be prevented in advance.

It should be noted that the term "transparent" in this specification includes chromatic transparency as well as achromatic transparency.

As described above, in the implement constructed in such a manner that moving the movable member provided inside the cylinder member relative to the cylinder member in accordance with rotation of the manipulator by a user enables to extrude and retract the preparation out of and into the cylinder member, the space is defined between the cylinder member and the movable member, and various representations such as the name of the article are provided in the space in such a manner that the user can recognize the representation from outside through the cylinder member. With this arrangement, deterioration of the representation such as smear and scuffing can be effectively prevented. Further, the projection formed on the cylinder member or the movable member securely keeps the space in a certain range. This arrangement provides a damage-free implement resulting from a frictional contact between the representation and the cylinder member regardless of the fact that the representation is provided in the space between the cylinder member and the movable member. Also, this arrangement is advantageous in smoothly extruding and retracting the preparation through the cylinder member without a likelihood that the cylinder member may radially displace during sliding movement of the cylinder member for extrusion and retraction of the preparation through the cylinder member.

Further, in the implement comprised of an elongated cylinder member and an operative member which is formed with an operative knob at a lead end thereof and is fitted in the cylinder member, the implement is constructed in such a manner that rotating the operative member relative to the cylinder member enables to extrude and retract the preparation accommodated in the operative member therethrough. In this implement, a space is defined between the cylinder member and the operative member. With this arrangement, a frictional resistance between the cylinder member and the operative member is reduced, and a user is enabled to extrude and retract the preparation through the operative member with a less external force. This arrangement improves the operability of the implement in the extrusion and retraction movement of the preparation. Further, since an air layer is formed in the space, the implement is provided with enhanced heat insulating effect. Thereby, the preparation is kept in a chemically stabilized state free from the influence of the external environment. This arrangement is advantageous in effectively preventing occurrence of a so-called "bucket bending" or "bucket falling" phenomenon resulting from softening of the preparation. Furthermore, since the projection formed on the cylinder member or the operative member securely keeps the space in a certain range, there is no likelihood that a smooth extrusion and retraction may be obstructed owing to radial displacement of the operative member during the extrusion and retraction.

In the above arrangements, providing representation including a picture and/or pattern on both of the cylinder member and the movable member, or cylinder member and the support member, or cylinder member and the operative member enables to move the representation on the movable member relative to the representation on the cylinder member in association with the extrusion and retraction movement of the preparation so as to provide a composite and superimposed image to a user. This arrangement also provides the implement with sophisticated appearance. This arrangement provides light blocking effect and the like, thereby effectively preventing deterioration and softening of the preparation.

Providing the representation in the space enables a user to recognize the representation through the transparent or semi-transparent cylinder member from outside. Furthermore, the cylinder member protects the representation from the influence of the external environment. Providing a ultraviolet blocking seal in the space effectively prevents deterioration of the preparation against ultraviolet ray and also protects the seal itself from damage owning to external contact. In this way, this arrangement enables to maintain the ultraviolet blocking performance of the seal for an extended period.

Providing the representation in the space enables a user to recognize the representation through the transparent or semi-transparent cylinder member from outside and to protect the representation from the influence of the external environment by the existence of the cylinder member.

Further, since the contact surface area of the inner surface of the cylinder member and the outer cylindrical surface of the operative member can be reduced, a frictional resistance between the surfaces of these casings can be lessened. As a result, a user can extrude and retract the preparation through the casing with a less external force. Further, since the projection securely keeps the space between the cylinder member and the operative member in a certain range, the implement is free from radial displacement of the operative member during the extrusion and retraction movement of the preparation. Furthermore, an air layer formed in the space between the operative member in which the preparation is accommodated and the cylinder member provides the implement with heat insulating effect. Accordingly, the chemical property of the preparation can be stabilized against change of the external environment. This arrangement effectively prevents softening of the preparation due to a body temperature even if the cylinder member is held by a hand of a user for an extended period to dispense the preparation.

This application is based on patent application No. 2000-403285 filed in Japan, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An implement for dispensing a preparation, comprising:

an outer cylinder member having a cylindrical wall extending along an axis of the outer cylinder member;

an operative member having a cylindrical body housed within the outer cylinder member to rotate relative to the outer cylinder member and prevent movement in the axial direction relative to the outer cylinder member;

a preparation holder for holding a preparation and being axially movable within the operative member;

a moving mechanism for moving the preparation holder along the axis of the outer cylinder member in response to relative rotation of the outer cylinder member and the operative member;

a space being defined between the cylinder member and the operative member; and a film provided on at least one of the surfaces of the outer cylinder member and the operative member that face the space, the film extending substantially axially so as to protect the preparation from heat or radiation.

2. The implement according to claim 1, wherein the moving mechanism includes a support member for supporting the preparation and being movable along the axis of the cylinder member.

3. The implement according to claim 2, wherein the support member is in the form of a cylinder, and further comprising a preparation moving mechanism including a screw shaft disposed rotatably about the axis of the cylinder member and operatively connected with the support member so as to move the support member along the axis of the cylinder member with a rotation of the screw shaft, and a manipulator for rotating the screw shaft.

4. The implement according to claim 3, wherein the space is formed by a projection which is formed on an outer surface of the support member and comes into contact with an inner surface of the cylinder member to define the space between the inner surface of the cylinder member and the outer surface of the support member.

5. The implement according to claim 2, wherein the cylinder member is formed with a thread in an inner surface of the cylinder member, and the preparation moving mechanism further includes a screw shaft integrally formed with the support member, a screw cylinder having an inner thread formed in an inner surface of the screw cylinder and an outer thread formed in an outer surface of the screw cylinder, the inner thread operatively connected with the screw shaft and the outer thread operatively connected with the thread of the cylinder member, and a manipulator operatively connected with the screw cylinder for rotating the screw cylinder, whereby the support member being moved along the axis of the cylinder member with a rotation of the screw cylinder.

6. The implement according to claim 5, wherein the support member is in the form of a cylinder, and the space former includes a projection which is formed an outer surface of the cylindrical support member and comes into contact with an inner surface of the cylinder member to define a space between the inner surface of the cylinder member and the outer surface of the cylindrical support member.

7. The implement according to claim 5, wherein the screw cylinder is spline-coupled with the manipulator.

8. The implement according to claim 5, wherein the screw cylinder is fixedly connected with the manipulator.

9. The implement according to claim 1, wherein:

the cylinder member is formed with a thread in an inner surface of the cylinder member;

the preparation moving mechanism further includes:

a support member for supporting the preparation, a screw shaft integrally formed with the support member, a screw cylinder having an inner thread formed in an inner surface of the screw cylinder and an outer thread formed in an outer surface of the screw cylinder, the inner thread operatively connected with the screw shaft and the outer thread operatively connected with the thread of the cylinder member; and the movable member includes a manipulator operatively connected with the screw cylinder for rotating the screw cylinder, whereby the cylinder member and the support member being moved in the opposite directions along the axis of the cylinder member with a rotation of the screw cylinder.

10. The implement according to claim 9, wherein the manipulator is in the form of a cylinder and rotatable about an axis of the cylinder member, and the space former includes a projection which is formed on an inner surface of the cylindrical manipulator and comes into contact with an outer surface of the cylinder member to define a space between the outer surface of the cylinder member and the inner surface of the cylindrical manipulator.

11. The implement for dispensing a preparation according to claim 1, wherein the outer cylinder is made of at least one of transparent and semi-transparent material and the film includes a representation on the surface facing the outer cylinder member.

12. The implement for dispensing a preparation according to claim 1, further comprising a second space defined between the operative member and the preparation holder to protect the preparation held by the preparation holder.

13. The implement for dispensing a preparation according to claim 1, wherein the space has a ring shape through which the cylinder member and the operative member slidably contact with each other for relative rotation.

14. The implement for dispensing a preparation, comprising:

an outer cylinder member having a cylindrical wall extending along an axis of the cylinder member;

an operative member having a cylindrical body housed within the outer cylinder member to rotate relative to the outer cylinder member but not move in the axial direction relative to the outer cylinder member;

a preparation holder for holding a preparation and axially movable within the operative member;

a moving mechanism for moving the preparation holder along the axis in response to relative rotation of the outer cylinder member and the operative member;

a space former for defining a space between the cylinder member and the operative member; and a film provided on at least one of the surfaces of the outer cylinder member and the operative member.

15. An implement for dispensing a preparation, comprising:

an outer cylinder member having a cylindrical wall extending along an axis of the outer cylinder member;

an operative member having a cylindrical body housed within the outer cylinder member to rotate relative to the outer cylinder member but not move in the axial direction relative to the outer cylinder member;

a preparation holder for holding a preparation and being axially movable within the operative member, the preparation member being formed with a recessed wall on an outside of the preparation holder to define a space between the operative member and the preparation holder;

a moving mechanism for moving the preparation holder along the axis of the outer cylinder member in response to relative rotation of the outer cylinder member and the operative member, keeping the space during the movement of the preparation holder and a film attached on the recessed wall of the preparation holder.

16. The implement for dispensing a preparation according to claim 15, wherein the preparation has a stick shape, and the preparation holder includes a cylindrical outer wall for holding a base portion of the preparation, and the recessed wall is formed on the cylindrical outer wall.

17. The implement for dispensing a preparation according to claim 16, wherein the outer cylinder and the operative member are made of a transparent or semi-transparent material.

18. The implement for dispensing a preparation according to claim 15, wherein the moving mechanism includes a threaded rod threadably coupled with the preparation holder, and extending along the axis in a radial center of the operative member.

* * * * *